169-45

2/5/85 OR 4,497,373

United States Patent [19]

Farquhar

[11] Patent Number: 4,497,373

[45] Date of Patent: Feb. 5, 1985

[54] FIRE AND EXPLOSION DETECTION AND SUPPRESSION

[75] Inventor: Robert L. Farquhar, Reading, England

[73] Assignee: Graviner Limited, High Wycombe, England

[21] Appl. No.: 404,726

[22] Filed: Aug. 3, 1982

[30] Foreign Application Priority Data

Aug. 20, 1981 [GB] United Kingdom ..... 8125485

[51] Int. Cl.[3] ..... A62C 3/00

[52] U.S. Cl. ..... 169/45; 169/61; 250/339; 250/342; 250/349

[58] Field of Search ..... 169/45, 46, 56, 60, 169/61; 250/339, 342, 349

[56] References Cited

U.S. PATENT DOCUMENTS

| | | | |
|---|---|---|---|
| 3,825,754 | 7/1974 | Cinzori et al. | 250/338 |
| 4,201,178 | 5/1980 | Tyrer et al. | 169/60 |
| 4,220,857 | 9/1980 | Bright | 250/339 |

FOREIGN PATENT DOCUMENTS

| | | |
|---|---|---|
| 12492 | 6/1980 | European Pat. Off. . |
| 3140678 | 5/1982 | Fed. Rep. of Germany . |
| 2380541 | 8/1978 | France . |
| WO81/01330 | 5/1981 | PCT Int'l Appl. . |
| 703530 | 2/1954 | United Kingdom . |
| 1307569 | 2/1973 | United Kingdom . |
| 1384320 | 2/1975 | United Kingdom . |
| 1398977 | 6/1975 | United Kingdom . |
| 1403601 | 8/1975 | United Kingdom . |
| 1431269 | 4/1976 | United Kingdom . |
| 1465524 | 2/1977 | United Kingdom . |
| 2020971 | 11/1979 | United Kingdom . |
| 2020420 | 11/1979 | United Kingdom . |
| 2022409 | 12/1979 | United Kingdom . |
| 1578611 | 11/1980 | United Kingdom . |
| 2060873 | 5/1981 | United Kingdom . |
| 2067749 | 7/1981 | United Kingdom . |
| 1595785 | 8/1981 | United Kingdom . |

*Primary Examiner*—Andres Kashnikow
*Assistant Examiner*—Jon M. Rastello
*Attorney, Agent, or Firm*—John K. Williamson

[57] ABSTRACT

The invention discriminates between the explosion of an ammunition round itself and the fire or explosion (e.g. a hydrocarbon fire) which may then take place in the object (e.g. a vehicle) struck by the round and initiates suppression of the latter fire or explosion only. The vehicle carries a radiation detector which measures the ratio of the intensities of the radiation at 3.4 and 4.4 microns. When an exploding ammunition round passes through the fuel tank entraining initially unburning hydrocarbon fuel with it, the detector measures a relatively low ratio because the unburning hydrocarbon fuel vapor between the burning round and the detector has a very intense absorption band at 3.4 microns. Fire suppression is thus initiated, so as to suppress the hydrocarbon fire which would very shortly follow. If the round does not strike the fuel tank, hydrocarbon fuel vapor is not present in the vicinity of the exploding ammunition round and the ratio measured by the detector is higher and explosion suppression is not initiated.

20 Claims, 7 Drawing Figures

FIRE AND EXPLOSION DETECTION AND SUPPRESSION

BACKGROUND OF THE INVENTION

The invention relates to fire and explosion detection systems and more specifically to systems which are able to discriminate between fires and explosions which need to be detected and fires, explosions and other radiation sources which do not.

Systems to be described by way of example below, and embodying the invention, may be used, for example, in situations where it is required to discriminate between the explosion of an ammunition round itself and a fire or explosion of combustible or explosive material which is set off by that round—so as to detect the fire or explosion set off by the round but not to detect the exploding round itself. In this way, the system can initiate action so as to suppress the fire or explosion set off by the round, but does not initiate such suppression action merely in response to the exploding round.

One particular application of the systems is for use in an armoured personnel carrier or battle tank which may be attacked by high energy anti-tank (H.E.A.T.) ammunition rounds. In such an application, the system is arranged to respond to hydrocarbon fires (that is, fires involving the fuel carried by the vehicle) set off by an exploding H.E.A.T.round or set off by hot metal fragments produced from or by the round (or set off by other causes), but not to detect either the exploding H.E.A.T.round itself (even when it has passed through the vehicle's armour into the vehicle itself), or the secondary non-hydrocarbon fire which may be produced by a pyrophoric reaction of the H.E.A.T. round with the vehicle's armour.

SUMMARY OF THE INVENTION

According to the invention, there is provided a fire and explosion detection system capable of detecting the presence of a flammable substance before it commences to burn, comprising detection means arranged to detect absorption of radiation in an absorption wavelength band characteristic of the said substance and to produce an output accordingly.

According to the invention, there is further provided a system for protecting a target carrying hydrocarbon fuel against hydrocarbon fires caused by attack by an exploding ammunition round but not against the exploding ammunition round itself, comprising radiation detection means mounted on the target so as to be capable of viewing an exploding ammunition round after it has struck the target, the detection means including a radiation detector arranged to be responsive to radiation in a narrow wavelength band centred at an intense absorption band characteristic of hydrocarbons so as to be capable of distinguishing between the relatively low radiation intensity in that band when the radiation from the exploding ammunition round is sensed through hydrocarbon vapour before the latter commences to burn and the relatively higher intensity in that band when the radiation from the exploding ammunition round is sensed in the absence of such a vapour, output means responsive to the signal from the radiation detector and capable of producing a warning output in the former condition but not the latter, and means responsive to the warning output to discharge a hydrocarbon fire suppressant or extinguishant.

DESCRIPTION OF THE DRAWINGS

Fire and explosion detection systems embodying the invention will now be described, by way of example only, with reference to the accompanying diagrammatic drawings in which.

DESCRIPTION OF PREFERRED EMBODIMENTS

Figure 1A:
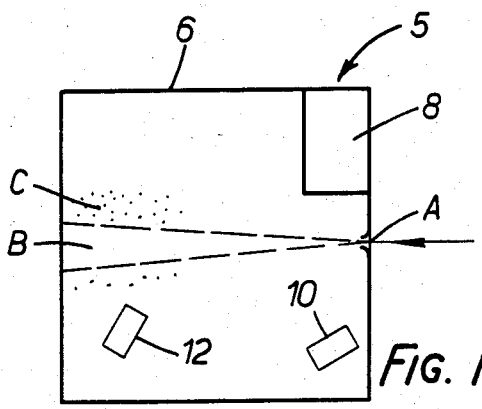
FIG. 1A is a diagrammatic drawing of an armoured personnel carrier or battle tank struck by an H.E.A.T. round which pierces the vehicle's armour but not its fuel tank.

FIG. 1A shows an armoured personnel carrier or battle tank 5, illustrated purely diagrammatically as a rectangular box having armoured walls 6 and a fuel tank 8. Mounted inside the vehicle is a detector 10 forming part of the fire and explosion detection system to be described; its associated circuitry is not specifically shown in FIGS. 1A and 1B.

FIG. 1A diagrammatically illustrates the armour 6 as being struck and pierced by an H.E.A.T. round at point A. As shown, the round does not strike the fuel tank 8 but passes through the armour into the interior of the vehicle. The round itself explodes and burns and therefore the burning round itself passes across the vehicle as shown diagrammatically as B, carrying with it burning fragments of the round and burning fragments of the armour as shown at C.

Figure 1B:
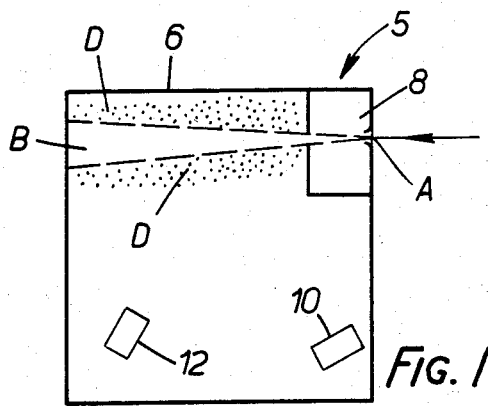
FIG. 1B is a view corresponding to FIG. 1A but showing the H.E.A.T. round having struck the vehicle's fuel tank.

FIG. 1B shows the corresponding situation when the exploding H.E.A.T.round strikes the armour 6 at A in the neighbourhood of the fuel tank 8 and passes through the fuel tank—and into the interior of the vehicle. In this case, therefore, the round, in passing through the wall of the fuel tank 8 inside the vehicle, will entrain some of the fuel from the fuel tank and carry the fuel with it across the vehicle as shown at D. Initially (for 10 milliseconds, say) the entrained fuel D will not start burning—but of course the round itself will be burning as it traverses the vehicle as shown an B. After approximately 10 to 20 milliseconds, for example, the entrained fuel will start to burn and the fire will of course rapidly spread to the fuel remaining in and exiting from the ruptured fuel tank 8.

The system to be more specifically described is arranged to differentiate between the conditions shown in FIG. 1A and FIG. 1B. More specifically, the system is designed so that, even though a fire or explosion is present in the FIG. 1A situation (the burning and exploding round shown at B), the detector 10 does not set off the discharge of extinguishant from extinguishers 12. In contrast, the system is arranged to respond to the FIG. 1B situation by causing the extinguishers 12 to discharge extinguishant so as to prevent, or to bring to a halt, the burning and explosion of the hydrocarbon fuel.

Figure 2:
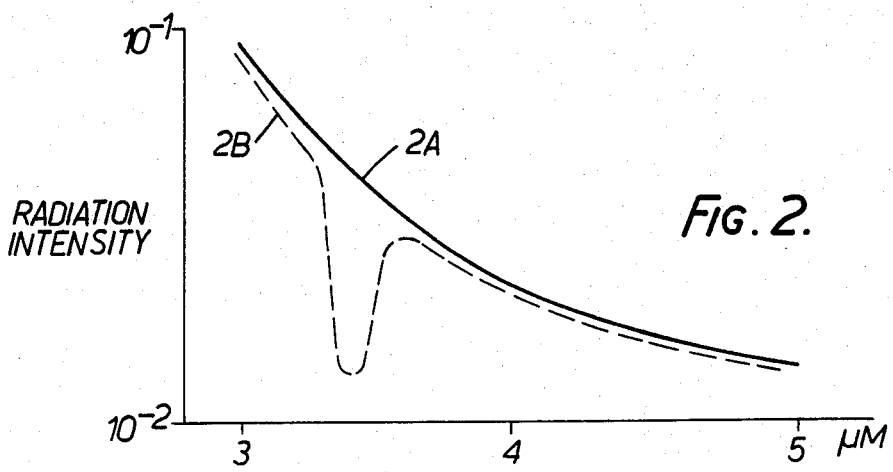
FIG. 2 shows spectral characteristics applicable to the conditions illustrated in FIGS. 1A and 1B.

FIG. 2 illustrates diagrammatically to spectral characteristics applicable to the FIG. 1A and FIG. 1B situations. The vertical axis in FIG. 2 represents intensity (in arbitrary units) and the horizontal axis represents wavelengths in microns.

The graph labelled 2A illustrates the FIG. 1A situation, that is, it illustrates the intensity of the radiation emitted at various wavelengths by the burning and exploding round shown at B in FIG. 1A. In this example, it is assumed that the armour 6 does not itself burn; it may, for example, be steel armour.

The graph shown at 2B in FIG. 2 illustrates the FIG. 1B situation where the burning and exploding round carries with it the entrained hydrocarbon fuel (at D, FIG. 1B); graph 2B illustrates the situation before this fuel begins to burn, that is, it illustrates the radiation produced by the burning and exploding round as viewed through the entrained fuel. As is apparent, there is a very pronounced attenuation of the radiation intensity at approximately 3.4 microns. This is caused by the intense absorption band between 3.3 and 3.5 microns of the hydrocarbons in the fuel.

In the system to be described in more detail below, the FIG. 1A situation and the FIG. 1B situation are differentiated by using the difference in shape of the graphs 2A and 2B.

Figure 3:
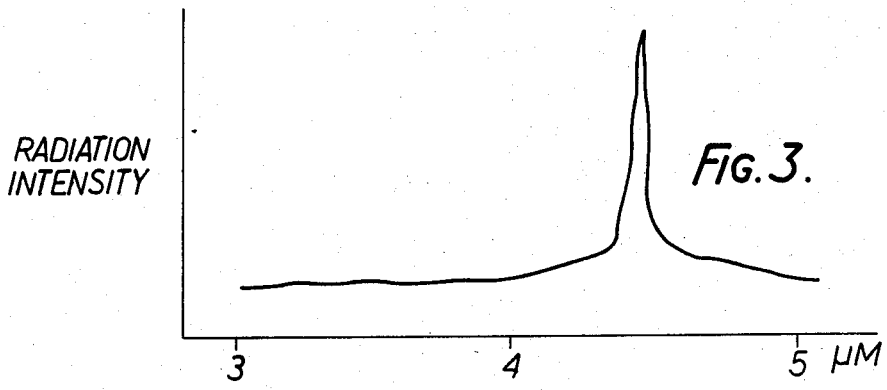
FIG. 3 shows the spectral characteristics of burning hydrocarbon.

FIG. 3 shows the radiation produced when the hydrocarbon fuel starts to burn. The axes in FIG. 3 correspond generally to those in FIG. 2 and show a pronounced peak at approximately 4.4 microns, due to the emission band at that wavelength of burning hydrocarbons. As explained above in connection with FIG. 1B, the condition shown in FIG. 3 does not arise immediately. As already indicated, the system being described is intended to discharge the extinguishant from the extinguishers 12 in the FIG. 1B situation before the fuel starts to burn; ideally, therefore, the fuel will not itself start to burn and the condition shown in FIG. 3 will not arise, though in practice it may do before full suppression action takes place. Additionally, the round may penetrate the fuel tank 8 and pass through its ullage space so entraining only a small amount of the fuel, insufficient perhaps to have a significant absorption effect on the radiation sensed by detector 10—and yet a fuel fire may be set off by the round in these circumstances. Furthermore, hydrocarbon fire may start within the vehicle for reasons other than its penetration by an H.E.A.T.round. The system being described is capable of sensing such fires and initiating their suppression, that is, it is capable of sensing a hydrocarbon fire whether or not it is preceded by a FIG. 1B situation (or, in fact, whether or not it is preceded by a FIG. 1A situation—though, as explained, the FIG. 1A situation would not normally precede a hydrocarbon fire).

Figure 4:
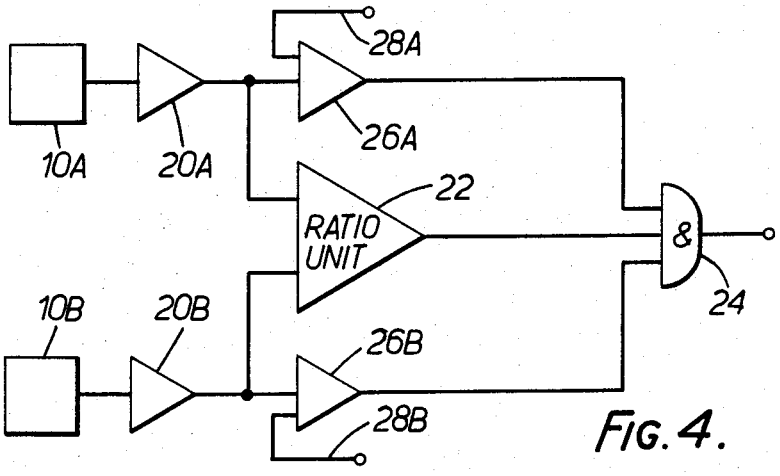
FIG. 4 is a circuit diagram of one form of the system.

FIG. 4 illustrates a simplified circuit diagram which one form of the system can have. As shown, the detector head 10 incorporates two radiation detectors, 10A and 10B. Each may be a thermopile, photoelectric or pyroelectric form of detector. Detector 10A is arranged to be sensitive to radiation in a narrow band centred at 3.4 microns (for example, by arranging for it to receive incoming radiation through a suitable filter). Detector 10B is likewise arranged to respond to radiation in a narrow band centred at 4.4 microns.

The output of each detector is amplified by a respective amplifier 20A, 20B and the amplified outputs are fed to respective inputs of a ratio unit 22 whose output feeds one input of an AND gate 24. In addition, the output of each amplifier 20A, 20B is fed into one input of a respective threshold comparator 26A, 26B, the second input of each such comparator receiving a respective reference on a line 28A, 28B. The outputs of the threshold comparators are fed into respective inputs of the AND gate 24.

The output of the AND gate 24 controls the fire extinguishers shown diagrammatically at 12 in FIGS. 1A and 1B.

In operation, the threshold comparators 26A and 26B detect when the outputs of the detectors 10A and 10B exceed relatively low thresholds and under such conditions each switches its output from binary "0" to binary "1". The ratio unit 22 measures the ratio between the outputs of the two detectors, that is, it measures the ratio of the intensity of the radiation at 3.4 microns to the intensity of the radiation at 4.4 microns. When this ratio is above a predetermined threshold value, the ratio unit 22 produces a binary "0" output. This corresponds to the situation in which the radiation intensity at 3.4 microns is relatively high compared with that at 4.4 microns and is thus indicative of the FIG. 1A situation as illustrated by the graph 2A in FIG. 2. Under these conditions, therefore, the AND gate 24 is prevented from producing an output and the extinguishers 12 are prevented from firing.

However, if the ratio unit 22 detects that the ratio is less than the predetermined threshold, its output is switched to binary "1". This condition therefore corresponds to a lower intensity of radiation at 3.4 microns compared with the radiation intensity at 4.4 microns and thus corresponds to the FIG. 1B situation illustrated by graph 2A in FIG. 2. Under these conditions, therefore, all the inputs of the AND gate 24 are at binary "1" and the gate produces an output which sets off the extinguishers 12. Therefore, the extinguishers have been set off before any actual hydrocarbon fire has started and thus either prevent its starting altogether or suppress it immediately it does start.

If a hydrocarbon fire should start for any other reason (that is, if the situation shown in FIG. 3 should arise), then the ratio unit 22 will produce a binary "1" output because the intensity of radiation at 4.4 microns is high compared with that at 3.4 microns, and assuming that the intensity of radiation picked up by the two detectors is greater than the values corresponding to the thresholds applied by the threshold comparators 26A and 26B, the AND gate 24 will again have all its inputs held at binary "1" and will set off the extinguishers.

Figure 5:
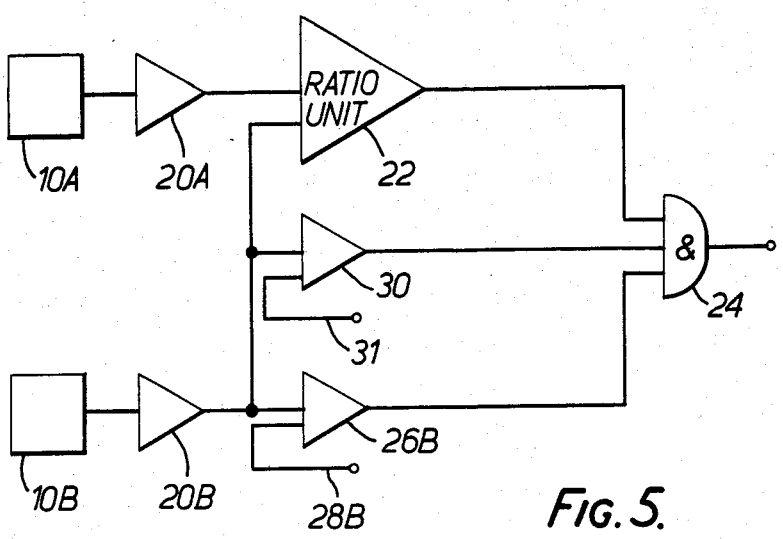
FIG. 5 is a circuit diagram of a modified form of the system of FIG. 4.

FIG. 5 shows a modified form of the system of FIG. 4, and items in FIG. 5 corresponding to those in FIG. 4 are correspondingly referenced.

As shown, the circuit of FIG. 5 differs from that of FIG. 4 in that the threshold comparator 26B of FIG. 4, responsive to the output of the detector 10A, is omitted. Only the output of the 4.4 micron detector, 10B, is fed to a threshold comparator, threshold comparator 26A. In addition, the output of detector 10B is fed to a rate of rise unit 30 which compares the rate of rise of the output from detector 10B with a predetermined rate of rise threshold applied on a line 31. The unit 30 produces a binary "1" output of the rate of rise from the output of the detector 10B exceeds the predetermined threshold, and this output is fed to the AND gate 24.

As before, the ratio unit 22 produces a binary "0" output when the ratio of the intensity of the radiation measured by the detector 10A (as represented by the output of the detector) to the intensity of the radiation measured by the detector 10B (as represented by the output of this detector) exceeds a predetermined threshold. This corresponds to the FIG. 1A situation, and the "0" output prevents the AND gate 24 from firing off the extinguishers.

When the ratio falls below the predetermined threshold, the output of the ratio unit 22 changes to binary "1", and the AND gate 24 sets off the extinguishers—assuming that the thresholds applied by the threshold comparators 22 and 30 are exceeded.

Figure 6:
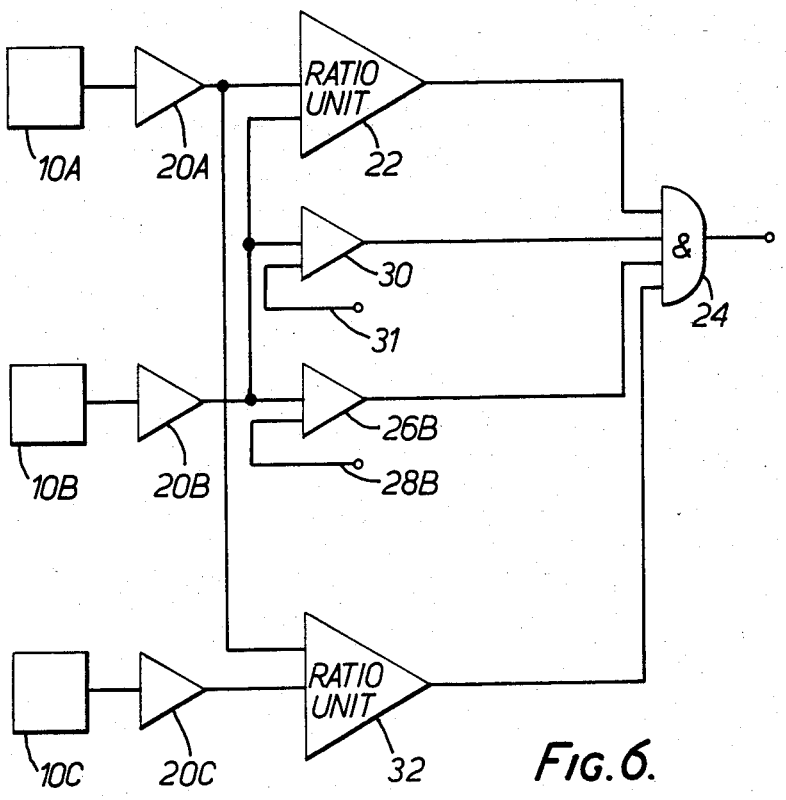
FIG. 6 is a circuit diagram of another form of the system.

FIG. 6 shows another form of the system in which colour temperature measurement is used to supplement the discrimination between the FIG. 1A and the FIG. 1B situation. Items in FIG. 6 corresponding to those in FIG. 5 are similarly referenced.

As shown in FIG. 6, an additional radiation detector, detector 10C, is incorporated in the radiation detector head 10 (see FIG. 1). Detector 10C is arranged to be sensitive to radiation in a narrow band centred at 0.5 microns (though this narrow band may be positioned at any convenient point in the range 0.5 to 0.9 microns, or at any other wavelength corresponding to the grey body continuum of the source). The output of detector 10C is simplified by an amplifier 20C and passed to one input of a ratio unit 32 whose second input is fed from the output of amplifier 20A (responding to the detector 10B).

The wavelengths (3.4 and 0.5 microns) to which the detectors 10A and 10C are sensitive are such that the ratio of the detector outputs is a measure of the apparent colour temperature of the event being monitored. The ratio unit 32 is set so as to produce a binary "0" output when the ratio measured represents an apparent colour temperature above a relatively high level (2,500 K., for example). When the apparent colour temperature is below this limit, the unit 32 produces a binary "1" output.

Therefore, the AND gate 24 will only receive four binary "1" inputs when (a) the radiation received by the 4.4 micron detector 10B is such that the detector output exceeds the threshold established by the threshold comparator 26A and its rate of rise exceeds the threshold established by the comparator 30, (b) the ratio unit 22 determines that the ratio of the output of detector 10A (3.4 microns) to the output of detector 10A is less than the predetermined threshold (corresponding to the FIG. 1B situation), and (c) the ratio unit 32 determines that the colour temperature is less than 2,500 K. If all these conditions are satisfied, the AND gate 24 produces a binary "1" output to set off the extinguishers 12 (FIG. 1). In all other conditions, the AND gate 24 will receive less than four binary "1's" and the extinguishers will not be set off.

The ratio unit 32 thus prevents the extinguishers being set off by a very high apparent colour temperature event such as the exploding H.E.A.T. round itself or any other interfering source of high colour temperature (even if the ratio unit 22 would otherwise permit the setting off of the extinguishers).

In all the systems, the second detector 10B, responsive to a band of radiation at 4.4 microns, allows them to operate in the presence of burning hydrocarbons, whether or not an exploding ammunition round is also present. It will be appreciated, however, that a system operating only in the presence of an ammunition round could be formed by using a second detector which is responsive more generally to the intensity of radiation in a band not associated with the absorption hydrocarbons (at 3.0 microns for example).

Although the examples described above have referred to non-burning (steel) armour, the systems also operate when the armour is of a type which does burn when struck by an H.E.A.T. round.

The Figures are merely exemplary of the forms which the systems may take.

What is claimed is:

1. A fire and explosion detection system responsive to radiation from fires and explosions and capable of discriminating between a first case in which radiation is produced from a source of fire and explosion in the presence of a flammable substance before it commences to burn and a second case in which radiation is produced therefrom in the absence of the flammable substance, so as to produce an alarm signal in the first case but not in the second case, comprising first and second radiation detection means arranged to produce electrical signals in response to radiation received in respective narrow wavelength bands, the wavelength band of the first radiation detection means being a band in which the said flammable substance absorbs radiation from the said source, and the wavelength band of the second radiation detection means being a band not associated with absorption by the flammable substance of radiation from the said source, and output means comprising means for comparing the electrical signals of the two detection means whereby to produce a said alarm signal indicative of the said first case when the comparison indicates that the signal from the first detection means is relatively low compared with the signal from the second detection means.

2. A system according to claim 1, including fire and explosion suppression means connected to receive the alarm signal so as to initiate fire or explosion suppression.

3. A system according to claim 1, in which the narrow wavelength band to which the second detector is responsive is a narrow wavelength band characteristic of a combustion product of the flammable substance.

4. A system according to claim 1, including means responsive to the signal produced by at least one of the detection means to block the said alarm signal if the signal level is less than a predetermined threshold.

5. A system according to claim 1, in which the said source of fire or explosion is a burning ammunition round.

6. A system according to claim 1, including means responsive to the signal produced by at least one of the two detectors to block the said output unless the signal level is rising at at least a predetermined rate.

7. A system according to claim 1, including a further detector responsive to radiation in a narrow wavelength band spaced from that of the first-mentioned detector such that a comparison of the signals from these detectors is a measure of apparent color temperature, and means for comparing the signals from these detectors to produce an inhibit signal for blocking the said output when the color temperature exceeds a predetermined value.

8. A fire and explosion detection method responsive to radiation from fires and explosions for discriminating between a first case in which radiation is produced from a source of fire and explosion in the presence of a flammable substance before it commences to burn and a second case in which radiation is produced therefrom in the absence of the flammable substance so as to produce an alarm signal in the first case but not in the second case, comprising the steps of detecting radiation in two different and distinct narrow wavelength bands, one of which is a wavelength band in which the said flammable substance absorbs radiation from the said source and the other of which is a wavelength band not associated with absorption by the flammable substance of radiation from the said source, comparing the intensities of radiation received in the two wavelength bands whereby to produce the said alarm signal indicating the said first case when the comparison indicates that the radiation intensity in the first band is relatively low compared with the radiation intensity in the second band.

9. A method according to claim 8, including the step of initiating fire or explosion suppression in response to the said alarm signal.

10. A method according to claim 8, in which the said source of fire and explosion is a burning ammunition round.

11. A method according to claim 10, in which the flammable substance is entrained unburning hydrocarbon fuel adjacent to the ammunition round.

12. A method according to claim 9, in which the detecting step compromises producing respective electrical signals in response to the radiation intensities respectively received in the narrow wavelength bands, and comparing the two electrical signals to produce the said alarm signal when the comparison indicates that the electrical signal corresponding to the radiation intensity in the first narrow wavelength band is relatively low compared with the electrical signal corresponding to the radiation intensity in the second wavelength band.

13. A method according to claim 8, in which the narrow wavelength band not associated with absorption by the flammable substance is a narrow wavelength band characteristic of a combustion product of the flammable substance.

14. A method according to claim 12, including the step of blocking the said alarm signal if the level of at least one of the electrical signals is less than a predetermined threshold.

15. A method according to claim 12, including the step of blocking the said output unless the level of at least one of the electrical signals is rising at at least a predetermined rate.

16. A system for protecting a target carrying hydrocarbon fuel against hydrocarbon fires caused by attack by an exploding ammunition round but not against the exploding ammunition round itself, comprising radiation detection means mounted on the target so as to be capable of viewing an exploding ammunition round after it has struck the target, the detection means including a first radiation detector arranged to be responsive to radiation in a narrow wavelength band centered at an intense absorption band characteristic of hydrocarbons and a second radiation detector responsive to the intensity of radiation in a band not associated with absorption of hydrocarbons, each said radiation detector producing a respective electrical signal corresponding to the radiation intensity detected in its respective band, ratio means reponsive to the two said electrical signals to measure the ratio therebetween so as to be capable of distinguishing between the condition when there is relatively lower radiation intensity in the band of the first radiation detector compared with the radiation intensity in the band of the second radiation detector, indicating that the radiation from the exploding ammunition round is being sensed through hydrocarbon vapour before the latter commentces to burn, and the condition when there is relatively higher intensity in the band of the first radiation detector compared with the radiation intensity in the band of the second radiation detector, indicating that the radiation from the exploding ammunition round is being sensed in the absence of such a vapour, the ratio means being operative to produce a warning output in the former condition but not the latter, and means responsive to the warning output to discharge a hydrocarbon fire suppressant or extinguishant.

17. A system according to claim 16, in which the second detector is responsive to the intensity of radiation in a narrow wavelength band characteristic of burning hydrocarbons so that said warning output is produced in the presence of burning hydrocarbons whether or not an exploding ammunition round is also present.

18. A system according to claim 16, including means responsive to the signal produced by at least one of the detectors to block the said warning output if the signal level is less than a predetermined threshold.

19. A system according to claim 16, including means responsive to the signal produced by at least one of the two detectors to block the said output unless the signal level is rising at at least a predetermined rate.

20. A system according to claim 16, in which the target comprises an armoured vehicle, the first condition is the condition when an exploding ammunition round strikes and penetrates the armour of the vehicle in the region of its fuel tank and explodes and passes into the interior entraining with it initially unburning hydrocarbon fuel, and the second condition is the condition when the round penetrates the armour at a position spaced from its fuel tank and explodes, then passing into the interior of the vehicle but carrying hydrocarbon fuel with it.

* * * * *